US007824312B1

(12) United States Patent
Hsu

(10) Patent No.: US 7,824,312 B1
(45) Date of Patent: Nov. 2, 2010

(54) EXERCISING HANDGRIP HAVING A TENSION ADJUSTABLE FUNCTION

(76) Inventor: Kuang-Chien Hsu, 146, Jiadian Rd., Chenping Li, Hemei Township, Changhua County (TW)

( * ) Notice: Subject to any disclaimer, the term of this patent is extended or adjusted under 35 U.S.C. 154(b) by 0 days.

(21) Appl. No.: 12/702,539

(22) Filed: Feb. 9, 2010

(51) Int. Cl.
*A63B 21/00* (2006.01)

(52) U.S. Cl. ..... 482/49; 482/108; 482/109

(58) Field of Classification Search ..... 482/49, 482/108–110, 126, 131; 73/379.03
See application file for complete search history.

(56) References Cited

U.S. PATENT DOCUMENTS 3,442,132 A * 5/1969 DeMare ..... 73/379.03
4,553,746 A * 11/1985 Lee ..... 482/49
5,556,359 A * 9/1996 Clementi ..... 482/49

* cited by examiner

*Primary Examiner*—Jerome Donnelly
(74) *Attorney, Agent, or Firm*—Alan Kamrath; Kamrath & Associates PA

(57) ABSTRACT

An exercising handgrip includes a base, a first handle mounted on the base, a second handle movably mounted on the first handle and disposed between the base and the first handle, a threaded tube movably mounted on the base, a tensile spring mounted in the threaded tube and biased between the threaded tube and the second handle, and a threaded adjusting knob rotatably mounted on the base and screwed onto the threaded tube. The base has two limit ribs. The threaded tube has two limit slots each slidable on the respective limit rib of the base. Thus, the adjusting knob is rotated in the base to move the threaded tube relative to the second handle and to compress or extend the tensile spring so as to adjust the tension of the tensile spring.

7 Claims, 6 Drawing Sheets

EXERCISING HANDGRIP HAVING A TENSION ADJUSTABLE FUNCTION

BACKGROUND OF THE INVENTION

1. Field of the Invention

The present invention relates to an exercising device and, more particularly, to an exercising handgrip.

2. Description of the Related Art

A conventional exercising handgrip comprises a torsion spring having two protruding ends and two handles mounted on the two protruding ends of the torsion spring. In operation, when a user's one hand holds and applies a force on the two handles to compress the torsion spring, the two handles are pressed toward each other, and when the force applied on the two handles us released, the two handles are pulled outward relative to each other by the restoring force of the torsion spring. Thus, the user has to apply a larger force to overcome the elastic force of the torsion spring so as to achieve an exercising effect of training the user's hands. However, the tension of the torsion spring is fixed and cannot be adjusted freely according to the user's requirement so that when the user wishes to change the tension of the torsion spring, he/she needs to prepare exercising handgrips of different tensions, thereby greatly increasing the costs and causing inconvenience in storage of the exercising handgrips.

BRIEF SUMMARY OF THE INVENTION

In accordance with the present invention, there is provided an exercising handgrip, comprising a base, a first handle mounted on the base, a second handle movably mounted on the first handle and disposed between the base and the first handle, a threaded tube movably mounted on the base, a tensile spring mounted in the threaded tube and biased between the threaded tube and the second handle, and a threaded adjusting knob rotatably mounted on the base and screwed onto the threaded tube.

The base has two opposite sides each provided with a mounting recess. The base has an upper portion provided with a mounting chamber and a lower portion provided with a mounting space connected to the mounting chamber. The mounting chamber of the base has two opposite sides each provided with a protruding limit rib. The mounting space of the base transversely extends through a whole width of the base and has a size greater than that of the mounting chamber of the base. The first handle includes a first holding portion and two guide posts mounted on the first holding portion respectively. Each of the two guide posts of the first handle has an upper end extending downward from two opposite ends of the first holding portion respectively and a lower end inserted into and secured in the respective mounting recess of the base. The second handle has an upper portion provided with a second holding portion facing the first holding portion of the first handle. The second handle has two opposite sides each provided with a sliding hole slidable on a respective one of the two guide posts of the first handle. The second handle has a lower portion provided with a receiving chamber. The threaded tube is movably mounted in the mounting chamber of the base. The threaded tube has an outer wall provided with an outer threaded portion. The outer threaded portion of the threaded tube has two opposite sides each provided with an elongate limit slot slidable on the respective limit rib of the base so that the threaded tube is movable axially relative to the base and is non-rotatable relative to the base. The tensile spring has a first end provided with a first hooked portion secured to the threaded tube and a second end provided with a second hooked portion extended into the receiving chamber of the second handle and secured to the second handle. The adjusting knob is rotatably mounted in the mounting space of the base. The adjusting knob has an inner wall provided with an inner threaded portion screwed onto the outer threaded portion of the threaded tube.

The primary objective of the present invention is to provide an exercising handgrip having a tension adjustable function.

According to the primary objective of the present invention, the adjusting knob is rotated in the mounting space of the base to drive the threaded tube to move upward or downward relative to the second handle and to compress or extend the tensile spring between the threaded tube and the second handle so as to adjust the tension of the tensile spring.

According to another objective of the present invention, the tension of the tensile spring can be adjusted freely so that the user only has to purchase a single exercising handgrip and needs not to prepare exercising handgrips of different tensions, thereby saving the cost, and thereby facilitating storage of the exercising handgrip.

According to a further objective of the present invention, the exercising handgrip has a simplified construction and is assembled easily and quickly, thereby saving the cost of fabrication.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

DETAILED DESCRIPTION OF THE INVENTION

Figure 1:
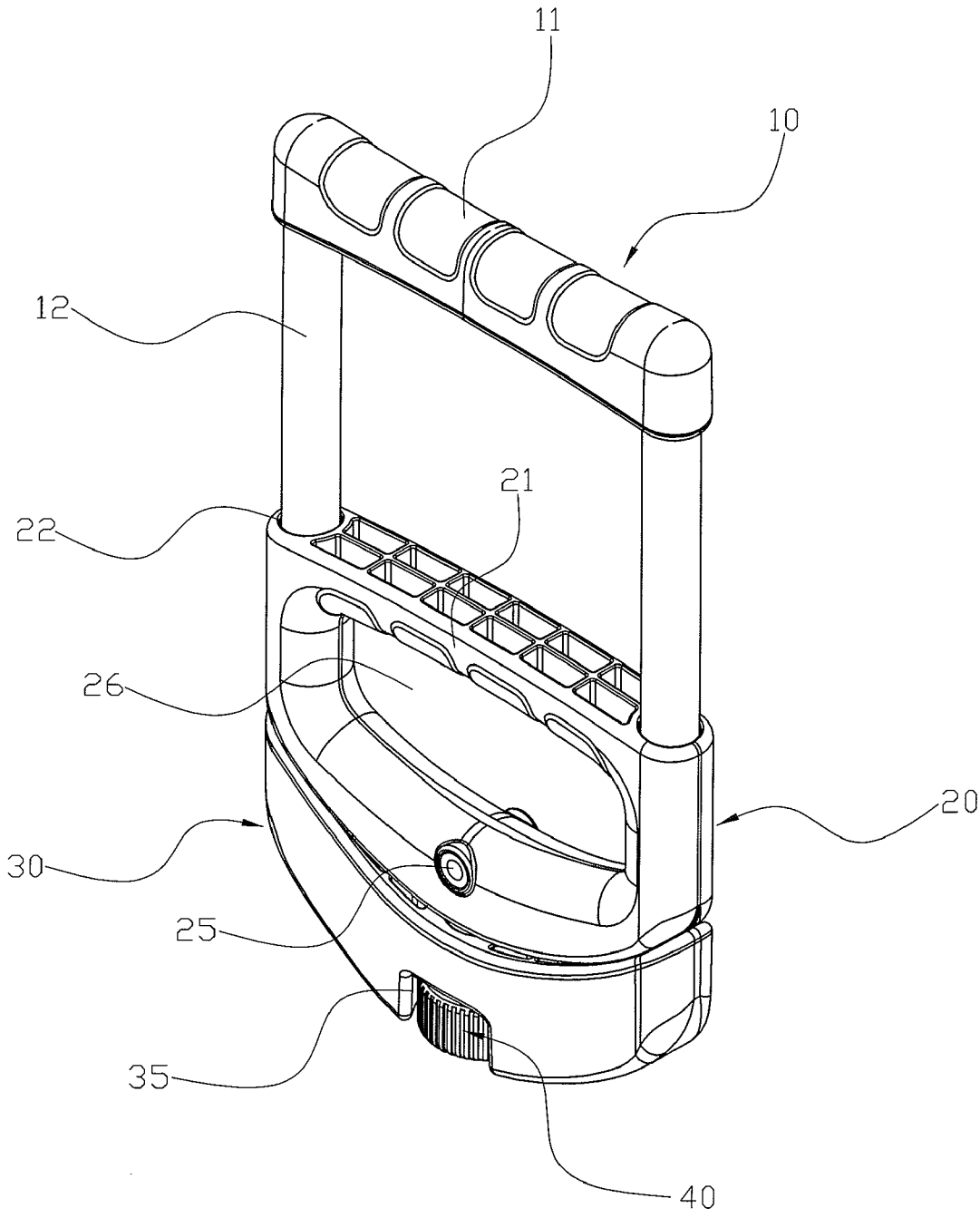
FIG. 1 is a perspective view of an exercising handgrip in accordance with the preferred embodiment of the present invention.
Figure 2:
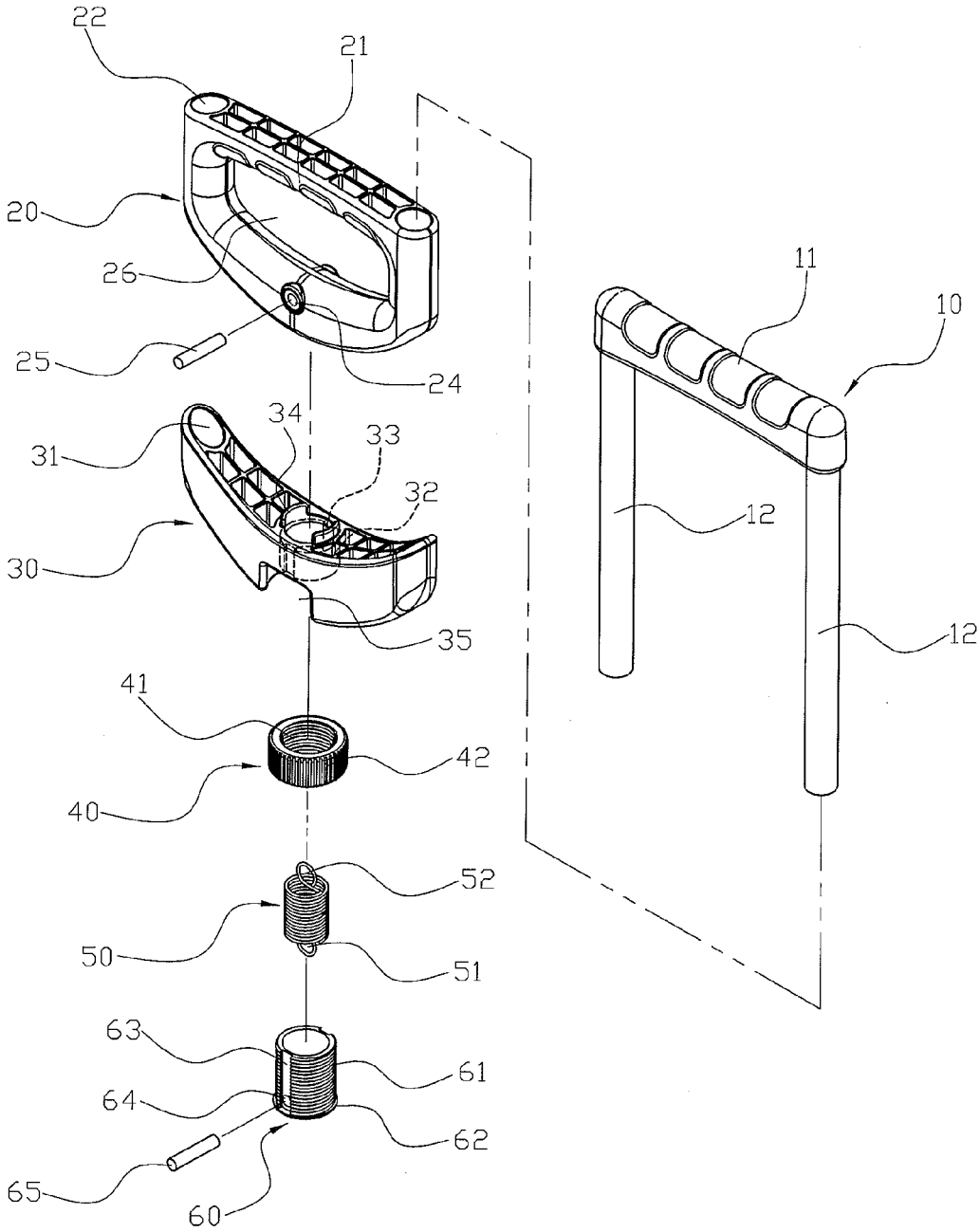
FIG. 2 is an exploded perspective view of the exercising handgrip as shown in FIG. 1.
Figure 3:
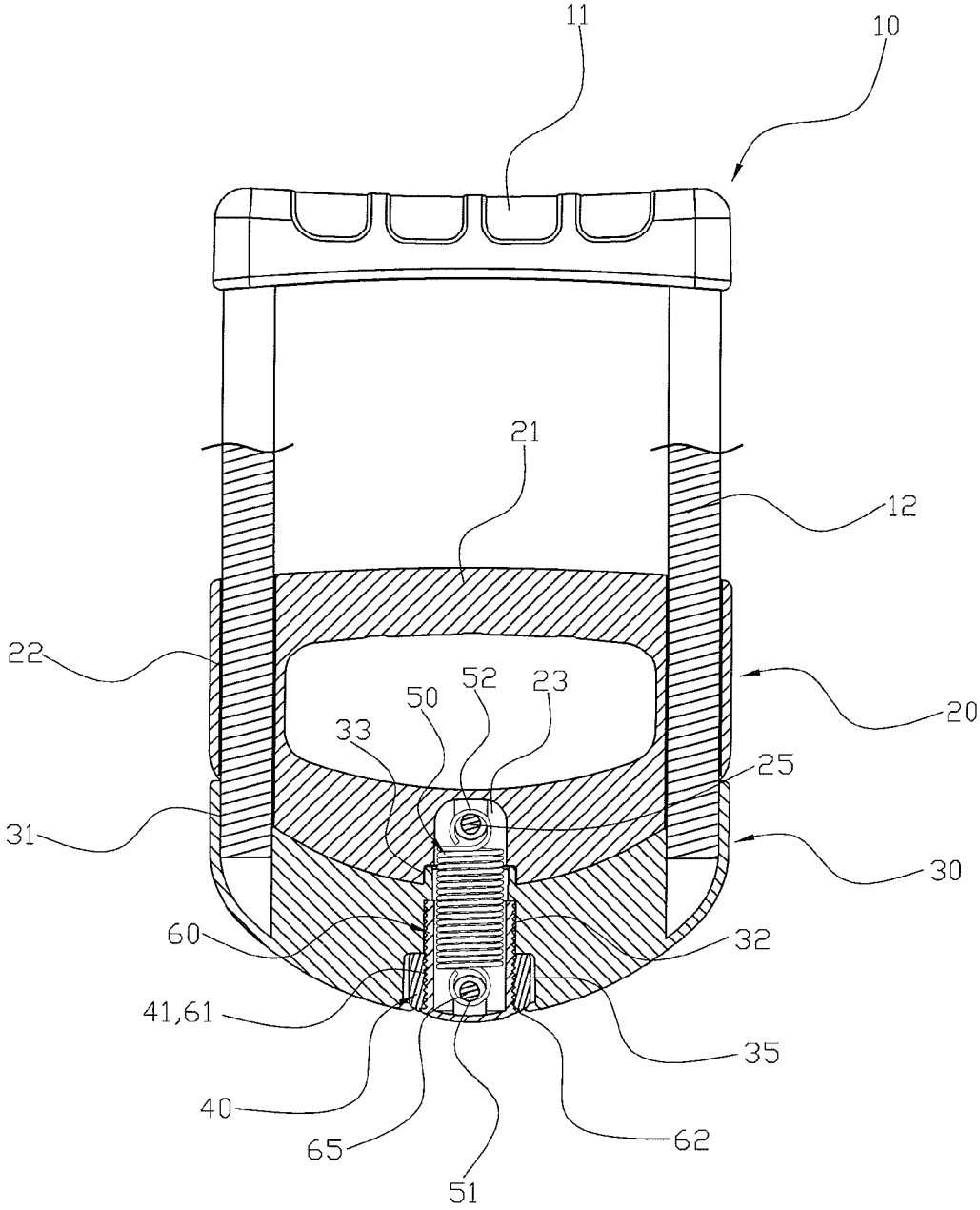
FIG. 3 is a front cross-sectional view of the exercising handgrip as shown in FIG. 1.
Figure 4:
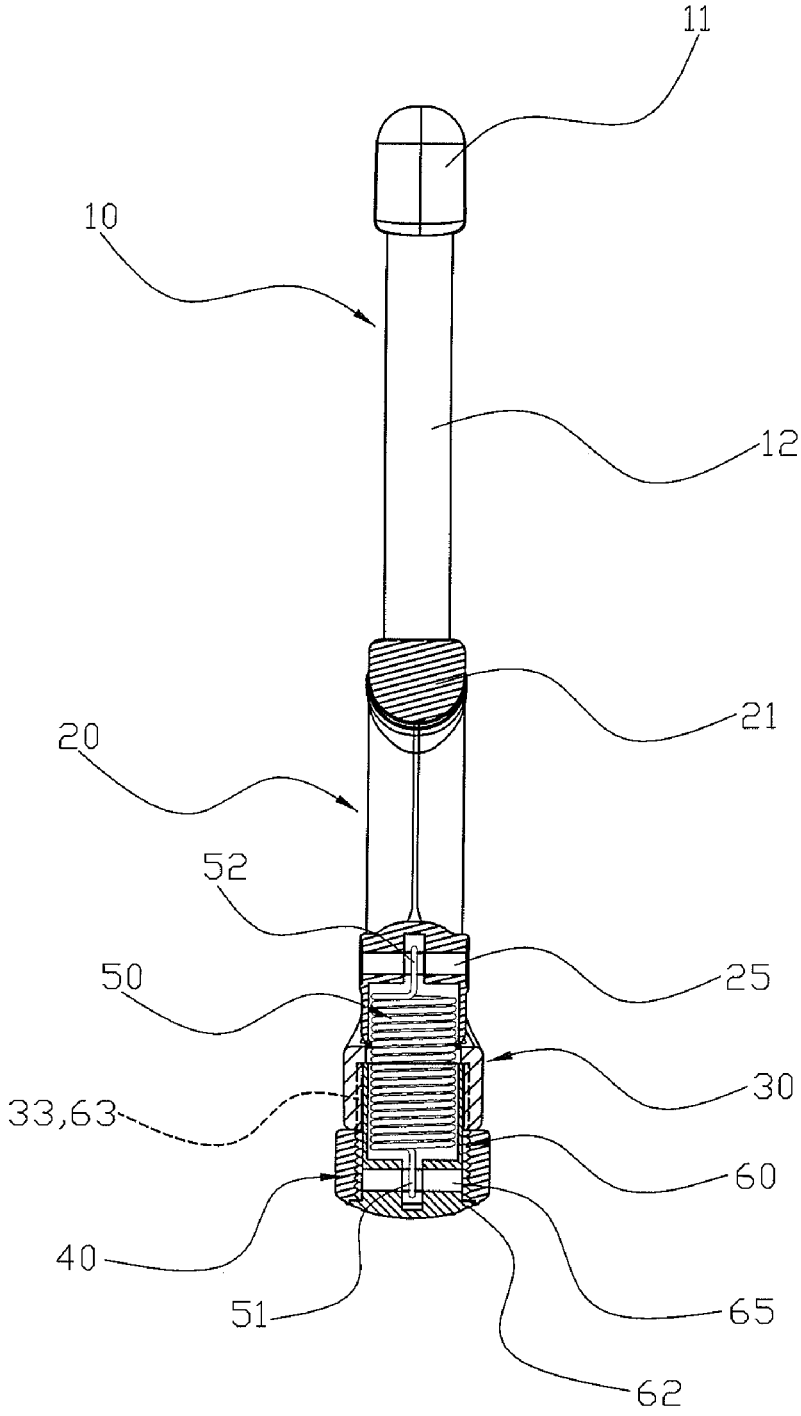
FIG. 4 is a side cross-sectional view of the exercising handgrip as shown in FIG. 1.

Referring to the drawings and initially to FIGS. 1-4, an exercising handgrip in accordance with the preferred embodiment of the present invention comprises a base 30, a first handle 10 mounted on the base 30, a second handle 20 movably mounted on the first handle 10 and disposed between the base 30 and the first handle 10, a threaded tube 60 movably mounted on the base 30, a tensile spring 50 mounted in the threaded tube 60 and biased between the threaded tube 60 and the second handle 20, and a threaded adjusting knob 40 rotatably mounted on the base 30 and screwed onto the threaded tube 60.

The base 30 has two opposite sides each provided with a mounting recess 31. The base 30 has an upper portion provided with a mounting chamber 32 and a lower portion provided with a mounting space 35 connected to the mounting chamber 32. The mounting chamber 32 of the base 30 has two opposite sides each provided with a protruding limit rib 33. The mounting chamber 32 of the base 30 has a top face provided with two radially opposite reinforcing ribs 34 which protrude outwardly from the mounting chamber 32 of the base 30. The mounting space 35 of the base 30 transversely extends through a whole width of the base 30 and has a size greater than that of the mounting chamber 32 of the base 30.

The first handle 10 has a substantially inverted U-shaped profile and includes a first holding portion 11 and two guide posts 12 mounted on the first holding portion 11 respectively. Each of the two guide posts 12 of the first handle 10 has an upper end extending downward from two opposite ends of the first holding portion 11 respectively and a lower end inserted into and secured in the respective mounting recess 31 of the base 30.

The second handle 20 has a substantially endless profile. The second handle 20 has an upper portion provided with a second holding portion 21 facing the first holding portion 11 of the first handle 10. The second handle 20 has a mediate portion provided with an endless hole 26, and the second holding portion 21 of the second handle 20 is located above the endless hole 26 of the second handle 20. The second handle 20 has two opposite sides each provided with a sliding hole 22 slidable on a respective one of the two guide posts 12 of the first handle 10. The second handle 20 has a lower portion provided with a receiving chamber 23. The receiving chamber 23 of the second handle 20 has a stepped shape. The lower portion of the second handle 20 has a surface provided with a fixing hole 24 connected to the receiving chamber 23 of the second handle 20. The lower portion of the second handle 20 has a substantially arc-shaped profile, and the upper portion of the base 30 has a substantially arc-shaped profile matching that of the lower portion of the second handle 20.

The threaded tube 60 is movably mounted in the mounting chamber 32 of the base 30. The threaded tube 60 has an outer wall provided with an outer threaded portion 61. The outer threaded portion 61 of the threaded tube 60 has two opposite sides each provided with an elongate limit slot 63 slidable on the respective limit rib 33 of the base 30 so that the threaded tube 60 is movable axially relative to the base 30 and is non-rotatable relative to the base 30. The threaded tube 60 has a lower end provided with an enlarged stop flange 62 which protrudes outwardly from the outer threaded portion 61 and is movable to abut a bottom of the adjusting knob 40. The threaded tube 60 has a surface provided with a fixing bore 64 connected to the limit slot 63.

The tensile spring 50 has a first end provided with a first hooked portion 51 secured to the threaded tube 60 and a second end provided with a second hooked portion 52 extended into the receiving chamber 23 of the second handle 20 and secured to the second handle 20.

The exercising handgrip further comprises a fixing pin 25 extending through the fixing hole 24 of the second handle 20 and the second hooked portion 52 of the tensile spring 50 to attach the second hooked portion 52 of the tensile spring 50 to the second handle 20, and a fixing rod 65 extending through the fixing bore 64 of the threaded tube 60 and the first hooked portion 51 of the tensile spring 50 to attach the first hooked portion 51 of the tensile spring 50 to the threaded tube 60.

The adjusting knob 40 is rotatably mounted in the mounting space 35 of the base 30. The adjusting knob 40 has an inner wall provided with an inner threaded portion 41 screwed onto the outer threaded portion 61 of the threaded tube 60. The adjusting knob 40 has an outer wall provided with a serrated operation portion 42 to facilitate a user rotate the adjusting knob 40. When in use, the threaded tube 60 is movable axially relative to the base 30 and is non-rotatable relative to the base 30, so that when the adjusting knob 40 is rotated in the mounting space 35 of the base 30, the threaded tube 60 is driven by the adjusting knob 40 to move upward or downward relative to the base 30 and the second handle 20 so as to compress or extend the tensile spring 50.

Figure 5:
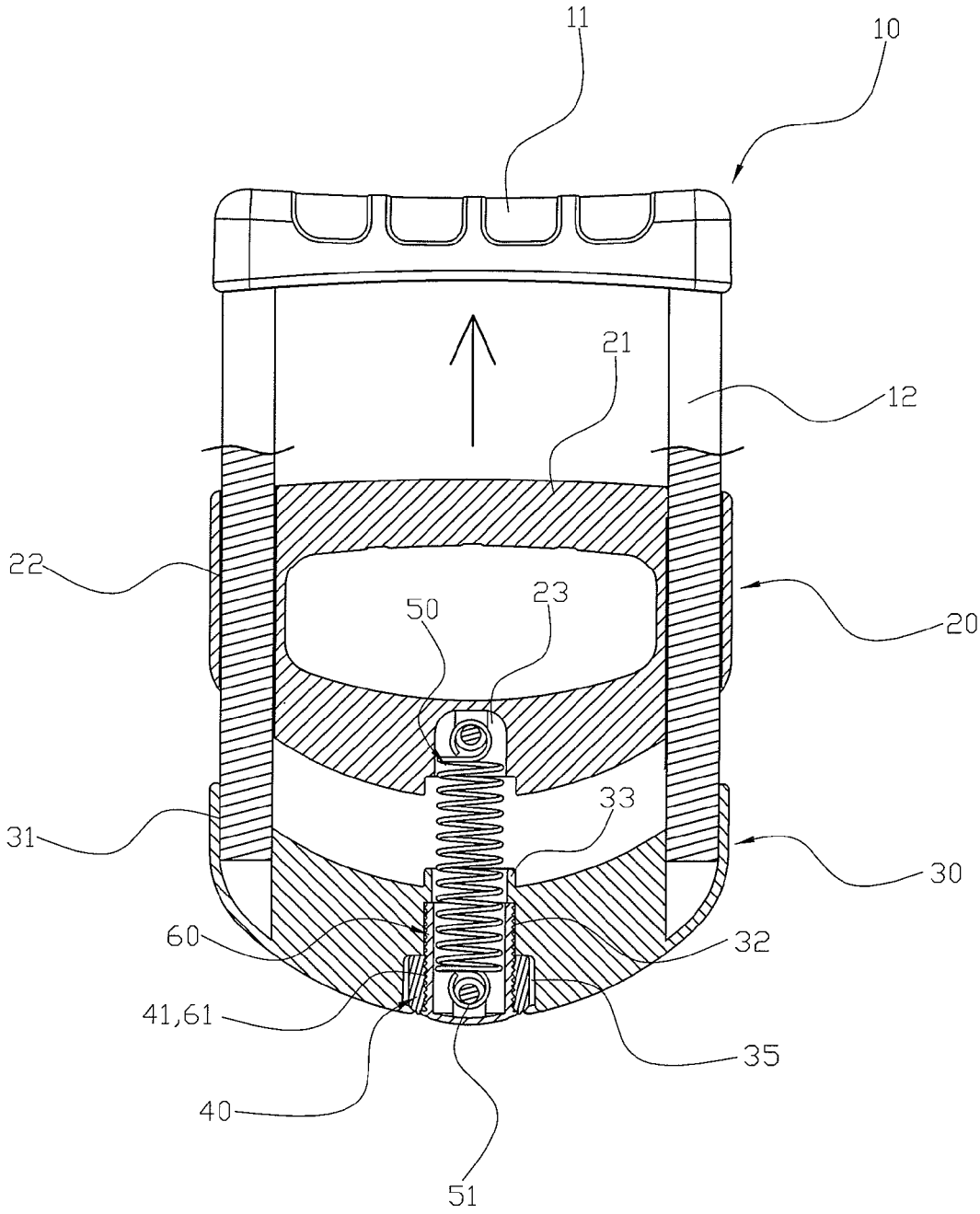
FIG. 5 is a schematic operational view of the exercising handgrip as shown in FIG. 3 in use.

In operation, referring to FIG. 5 with reference to FIGS. 1-4, when a user's one hand holds and applies a force on the first holding portion 11 of the first handle 10 and the second holding portion 21 of the second handle 20, the second holding portion 21 of the second handle 20 is pushed toward the first holding portion 11 of the first handle 10 by guidance of the two guide posts 12 of the first handle 10. At this time, the user has to apply a larger force to overcome the elastic force of the tensile spring 50 between the threaded tube 60 and the second handle 20 so as to move the second holding portion 21 of the second handle 20 toward the first holding portion 11 of the first handle 10 reciprocally so as to achieve an exercising effect of training the user's hands.

Figure 6:
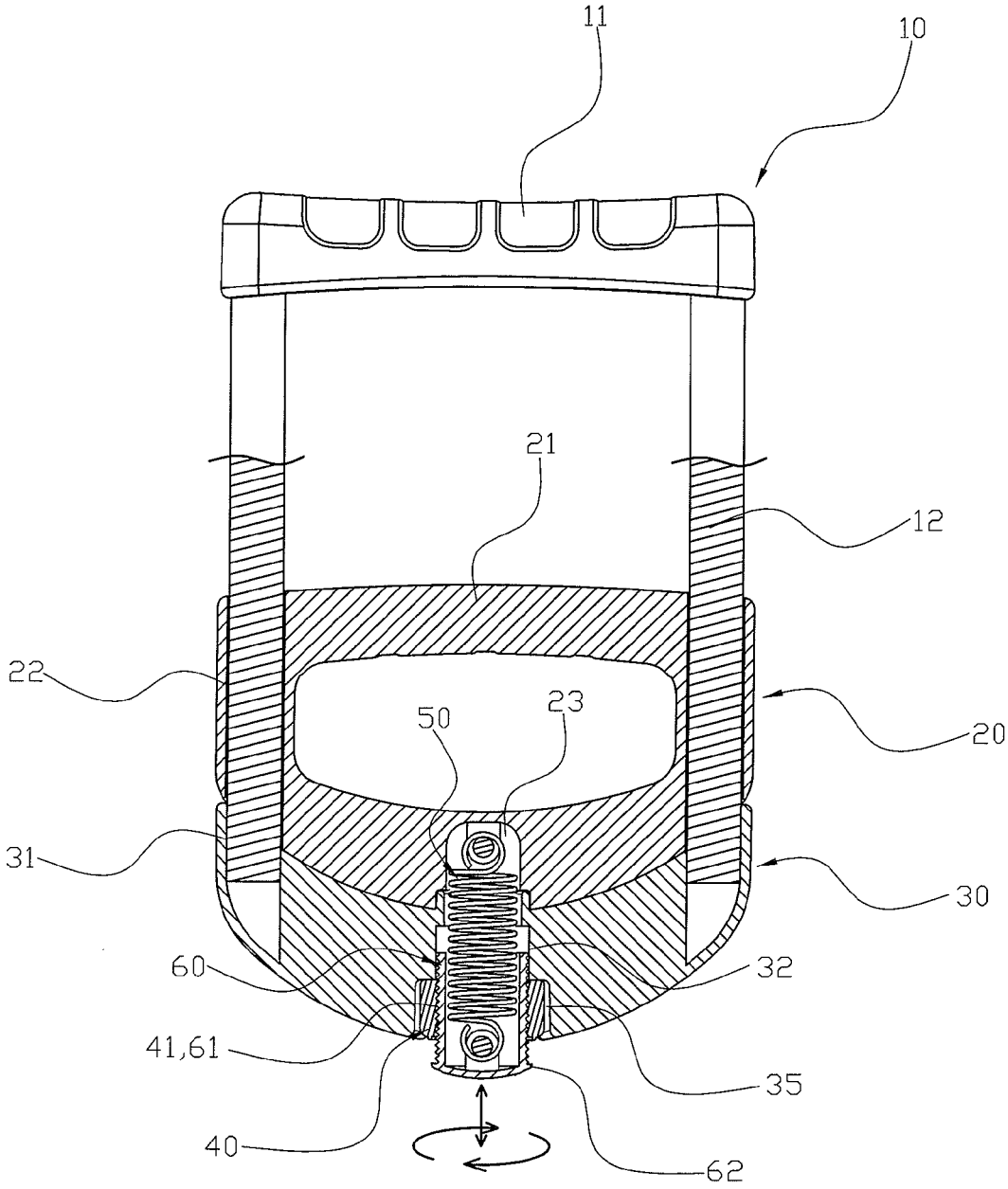
FIG. 6 is a schematic operational view of the exercising handgrip as shown in FIG. 3 in adjustment.

In adjustment, referring to FIG. 6 with reference to FIGS. 1-4, when the user wishes to adjust the tension of the tensile spring 50, the adjusting knob 40 is rotated in the mounting space 35 of the base 30, so that the threaded tube 60 is driven by the adjusting knob 40 to move upward or downward relative to the base 30 and the second handle 20 and to compress or extend the tensile spring 50 so as to adjust the tension of the tensile spring 50.

Accordingly, the adjusting knob 40 is rotated in the mounting space 35 of the base 30 to drive the threaded tube 60 to move upward or downward relative to the second handle 20 and to compress or extend the tensile spring 50 between the threaded tube 60 and the second handle 20 so as to adjust the tension of the tensile spring 50. In addition, the tension of the tensile spring 50 can be adjusted freely so that the user only has to purchase a single exercising handgrip and needs not to prepare exercising handgrips of different tensions, thereby saving the cost, and thereby facilitating storage of the exercising handgrip. Further, the exercising handgrip has a simplified construction and is assembled easily and quickly, thereby saving the cost of fabrication.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

The invention claimed is:

1. An exercising handgrip, comprising:

a base;

a first handle mounted on the base;

a second handle movably mounted on the first handle and disposed between the base and the first handle;

a threaded tube movably mounted on the base;

a tensile spring mounted in the threaded tube and biased between the threaded tube and the second handle; and a threaded adjusting knob rotatably mounted on the base and screwed onto the threaded tube;

wherein the base has two opposite sides each provided with a mounting recess;

the base has an upper portion provided with a mounting chamber and a lower portion provided with a mounting space connected to the mounting chamber;

the mounting chamber of the base has two opposite sides each provided with a protruding limit rib;

the mounting space of the base transversely extends through a whole width of the base and has a size greater than that of the mounting chamber of the base;

the first handle includes a first holding portion and two guide posts mounted on the first holding portion respectively;

each of the two guide posts of the first handle has an upper end extending downward from two opposite ends of the first holding portion respectively and a lower end inserted into and secured in the respective mounting recess of the base;

the second handle has an upper portion provided with a second holding portion facing the first holding portion of the first handle;

the second handle has two opposite sides each provided with a sliding hole slidable on a respective one of the two guide posts of the first handle;

the second handle has a lower portion provided with a receiving chamber;

the threaded tube is movably mounted in the mounting chamber of the base;

the threaded tube has an outer wall provided with an outer threaded portion;

the outer threaded portion of the threaded tube has two opposite sides each provided with an elongate limit slot slidable on the respective limit rib of the base so that the threaded tube is movable axially relative to the base and is non-rotatable relative to the base;

the tensile spring has a first end provided with a first hooked portion secured to the threaded tube and a second end provided with a second hooked portion extended into the receiving chamber of the second handle and secured to the second handle;

the adjusting knob is rotatably mounted in the mounting space of the base;

the adjusting knob has an inner wall provided with an inner threaded portion screwed onto the outer threaded portion of the threaded tube.

2. The exercising handgrip of claim 1, wherein the second handle has a substantially endless profile;

the second handle has a mediate portion provided with an endless hole; and the second holding portion of the second handle is located above the endless hole of the second handle.

3. The exercising handgrip of claim 1, wherein the receiving chamber of the second handle has a stepped shape;

the lower portion of the second handle has a surface provided with a fixing hole connected to the receiving chamber of the second handle; and the exercising handgrip further comprises:

a fixing pin extending through the fixing hole of the second handle and the second hooked portion of the tensile spring to attach the second hooked portion of the tensile spring to the second handle.

4. The exercising handgrip of claim 1, wherein the mounting chamber of the base has a top face provided with two radially opposite reinforcing ribs which protrude outwardly from the mounting chamber of the base.

5. The exercising handgrip of claim 1, wherein the adjusting knob has an outer wall provided with a serrated operation portion.

6. The exercising handgrip of claim 1, wherein the threaded tube has a lower end provided with an enlarged stop flange which protrudes outwardly from the outer threaded portion and is movable to abut a bottom of the adjusting knob.

7. The exercising handgrip of claim 1, wherein the threaded tube has a surface provided with a fixing bore connected to the limit slot; and the exercising handgrip further comprises:

a fixing rod extending through the fixing bore of the threaded tube and the first hooked portion of the tensile spring to attach the first hooked portion of the tensile spring to the threaded tube.

* * * * *